US006799490B1

(12) United States Patent
Chu

(10) Patent No.: US 6,799,490 B1
(45) Date of Patent: Oct. 5, 2004

(54) LEVER CORKSCREW

(76) Inventor: Kuo-Chih Chu, No. 175, Lane 174, Gongyi Rd., Taichung (TW)

( * ) Notice: Subject to any disclaimer, the term of this patent is extended or adjusted under 35 U.S.C. 154(b) by 0 days.

(21) Appl. No.: 10/440,343

(22) Filed: May 15, 2003

(51) Int. Cl.[7] ..... B67B 7/62
(52) U.S. Cl. ..... 81/3.37; 81/3.33; 81/3.36
(58) Field of Search ..... 81/3.37, 3.08, 81/3.33, 3.36

(56) References Cited

U.S. PATENT DOCUMENTS 1,753,026 A * 4/1930 Rosati ..... 81/3.37
2,115,289 A * 4/1938 Smythe ..... 81/3.37
4,063,473 A * 12/1977 Bozzo ..... 81/3.37
4,399,720 A * 8/1983 Cuppett ..... 81/3.37
4,750,391 A * 6/1988 Sweatt ..... 81/3.37
5,000,063 A * 3/1991 Federighi, Sr. ..... 81/3.37
5,924,338 A * 7/1999 Peck ..... 81/3.37
5,934,160 A * 8/1999 Gibson ..... 81/3.37
6,427,556 B2 * 8/2002 Fabbro ..... 81/3.37

* cited by examiner

*Primary Examiner*—Derris H. Banks
*Assistant Examiner*—Ali Abdelwahed
(74) *Attorney, Agent, or Firm*—Dellett & Walters

(57) ABSTRACT

A lever corkscrew has a body and a central spindle received inside the body. A transport assembly is slidably mounted inside the body, and two anchors securely are mounted on the one side of the transport assembly. Two arms with tooth-like protrusions are pivoted with the body and the protrusions are engaged with the central spindle. The central spindle is securely mounted on the transport assembly on the one side different with the side mounted with the anchors. When turning up the arms or turning down the arms, the central spindle will be driven up or down and also drive the transport assembly with the anchors to pull out the cork.

7 Claims, 5 Drawing Sheets

LEVER CORKSCREW

BACKGROUND OF THE INVENTION

1. Field of the Invention

The present invention relates to a lever corkscrew, and more particularly to a lever corkscrew with two anchors.

2. Description of Related Art

Corkscrews are used to remove a real or a synthetic cork from a bottle. A conventional corkscrew has a body, two arms pivoted with the body and a wormscrew received inside the body. The wormscrew longitudinally penetrates the center of the cork and the cork is removed also in this direction. However, it is often experienced that the wormscrew enters the cork somewhat obliquely whereby the cork side periphery is eventually broken through and the cork may then disintegrate. Such disintegration results in cork fragments contaminating the wine, or worse, most of the cork remains in the bottle and cannot be further screwed so that the wine is wasted.

The present invention provides a lever corkscrew with two anchors to mitigate and obviate the aforementioned problem.

SUMMARY OF THE INVENTION

The primary objective of the present invention is to provide a lever corkscrew that has a body and a central spindle received inside the body. A transport assembly is slidably mounted inside the body, and two anchors are securely mounted in the transport assembly. Two arms with tooth-like protrusions are pivoted with the body and the protrusions are engaged with the central spindle. The central spindle is securely mounted on the transport assembly on one side different to the side mounted on the anchors. When turning up or turning down the arms, the central spindle will be driven up or down and also drive the transport assembly with the anchors to pull out the cork.

Other objects, advantages and novel features of the invention will become more apparent from the following detailed description when taken in conjunction with the accompanying drawings.

DETAILED DESCRIPTION OF THE PREFERRED EMBODIMENT

Figure 1:
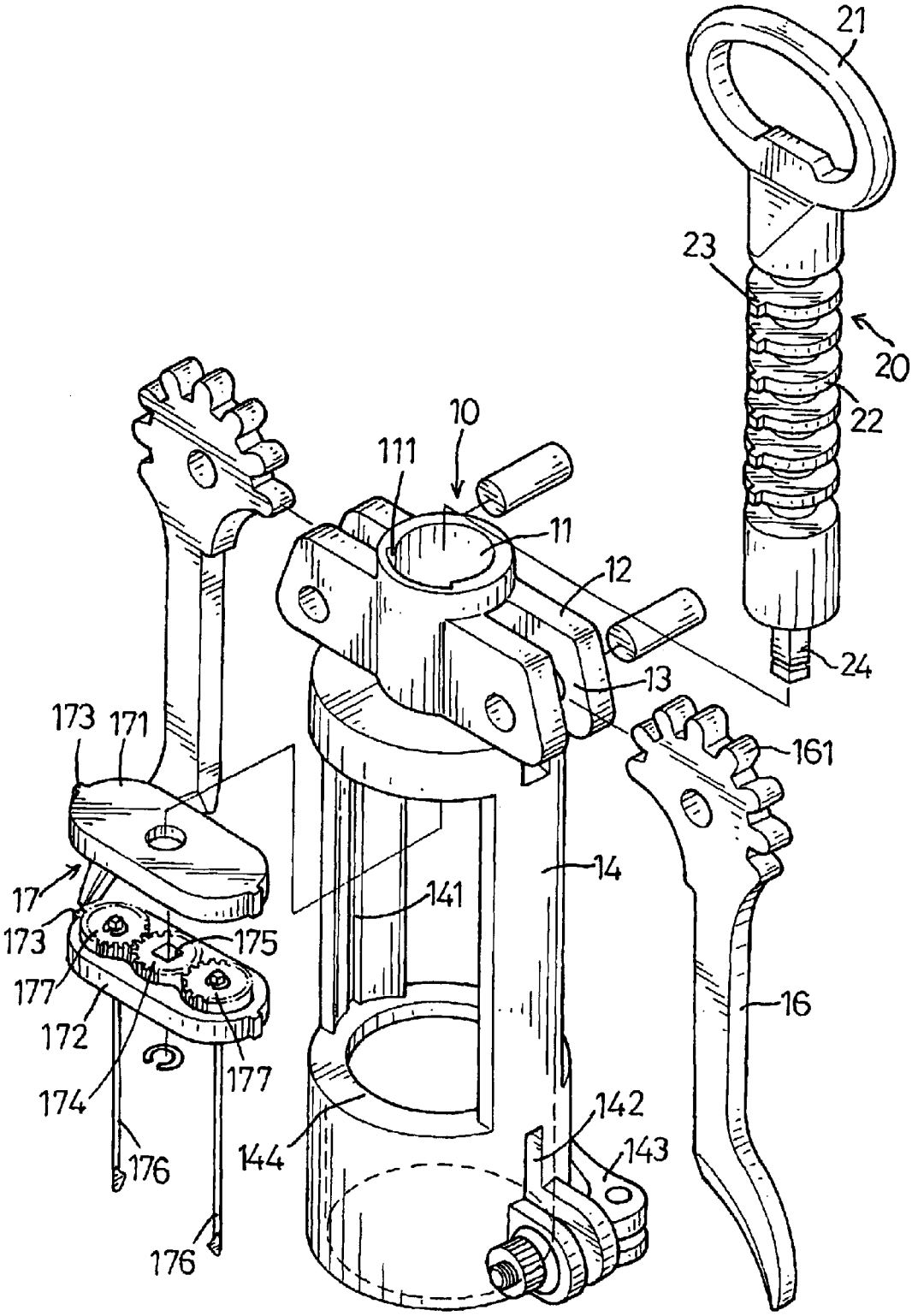
FIG. 1 is an exploded perspective view of a corkscrew in accordance with the present invention.
Figure 2:
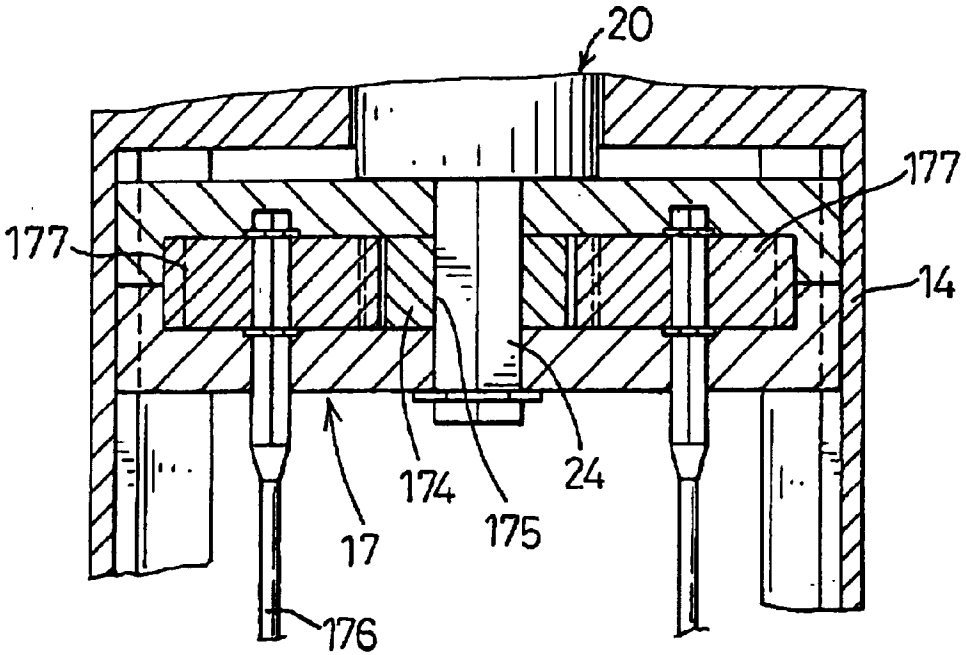
FIG. 2 is an enlarged partial plan view of the corkscrew in FIG. 1.

With reference to FIGS. 1 and 2, a lever corkscrew has a body (10), a hollow cylinder (14), two arms (16), a transport assembly (17) and a central spindle (20).

The body (10) has a proximal end (not numbered), a distal end (not numbered), an inner surface (not numbered) and an outside surface (not numbered), an upper through hole (11) and two shoulders (12). The upper through hole (11) is defined through the proximal end of the body (10). A recess (111) is defined through the inner surface of the body (10) and communicated with the upper through hole (11). The shoulders (12) have a bottom side (not numbered) and are formed on the outside surface of the body (10) and are opposite with each other. A slot (13) is defined in each shoulder (12). A hole (not numbered) is transversely defined through each shoulder (12).

The hollow cylinder (14) has an inner cavity (not numbered), a distal end (not numbered), a proximal end (not numbered), an inside surface (not numbered), an outside surface (not numbered), two tracks (141), a longitudinal slot (142), two tabs (not numbered), a quick release handle (143) and a collar (144). The proximal end of the hollow cylinder (14) is integrally formed with the distal end of the body (10) and the bottom side of the shoulders (12), and the upper through hole (11) is communicated with the inner cavity in the hollow cylinder (14). The slots (13) are also communicated with the upper through bole (11) of the body (10). Two tracks (141) are formed inside the inner surface of the cylinder (14) and respective face each other. The longitudinal slot (142) is defined through the outside surface near the distal end of the hollow cylinder (14). Two tabs are formed on the outside surface of the hollow cylinder (14) and are opposite each other beside the longitudinal slot (142). The quick release handle (143) is mounted through the two tabs. The collar (144) is formed on the inner surface of the inner cavity of the hollow cylinder (14) near the distal end. The collar (144) has an opening at the bottom and sized to receive a tip of a bottle neck therein, and an O-shaped flange at the top and sized such that the flange will abut the tip of the bottle neck yet allow a cork to pass through the flange.

The arms (16) are respectively mounted inside the slots (13) of the shoulders (12) and each arm (16) is pivoted with one of the shoulders (12) by a respective pivot pin (not numbered). Each arm (16) has a proximal enlarged flat head (not numbered), a periphery (not numbered) and multiple tooth-like protrusions (161). The multiple tooth-like protrusions (161) are formed on the periphery of the proximal enlarged flat head.

The transport assembly (17) has a top cover (171), a base cover (172), an elliptical periphery (not numbered), a cavity (not numbered), four transverse protrusions (173), a central gear wheel (174), two anchors (176) and two lateral gear wheels (177). The top cover (171) is securely mounted on the base cover (172) and forms the cavity inside the combined top cover (171) and the base cover (172). A central hole (not numbered) is defined through the top cover (171) and two lateral holes (not numbered) are defined through the base cover (172). Two of the transverse protrusions (173) are formed on the two end of elliptical periphery of the top cover (171) and the other two of the transverse protrusions (173) are formed on the base cover (172) corresponding to the top cover (171). The transverse protrusions (173) are respectively received inside the tracks (141). The central gear wheel (174) is mounted between and engaged with the two lateral gear wheels (177) inside the cavity of the top cover (171) and the base cover (172). The central gear wheel (174) has a square hole (175) defined through the central gear wheel (174). Each anchor (176) has a proximal end (not numbered), a distal end (not numbered) and a hook integrally formed on the distal end of the anchor (176). The proximal ends of the anchors (176) are mounted inside the respective lateral gear wheel (177) through the lateral holes of the base cover (172). The proximal end of each anchor (176) is fixed to the respective lateral gear wheel (177) by one of two C-shaped clips. Each hook of the anchors (176) extends parallelly in an opposite direction to the other at 180° before using the lever corkscrew in accordance with the present invention.

The central spindle (20) is received inside the through hole (11) and has a distal end (not numbered), a proximal end (not numbered), a handle (21), a lead screw (22), a protrusion key (23) and a post (24). The handle (21) is formed on the proximal end of the spindle (20) and integrally formed with the lead screw (22) and the post (24). The protrusion key (23) is longitudinally formed on the lead screw (22) and received inside the recess (111). The lead screw (22) is engaged with the respective multiple tooth-like protrusions (161) of the arms (16). The post (24) is inserted into the square hole (175) of the central gear wheel (174) of the transport assembly (17).

Figure 3:
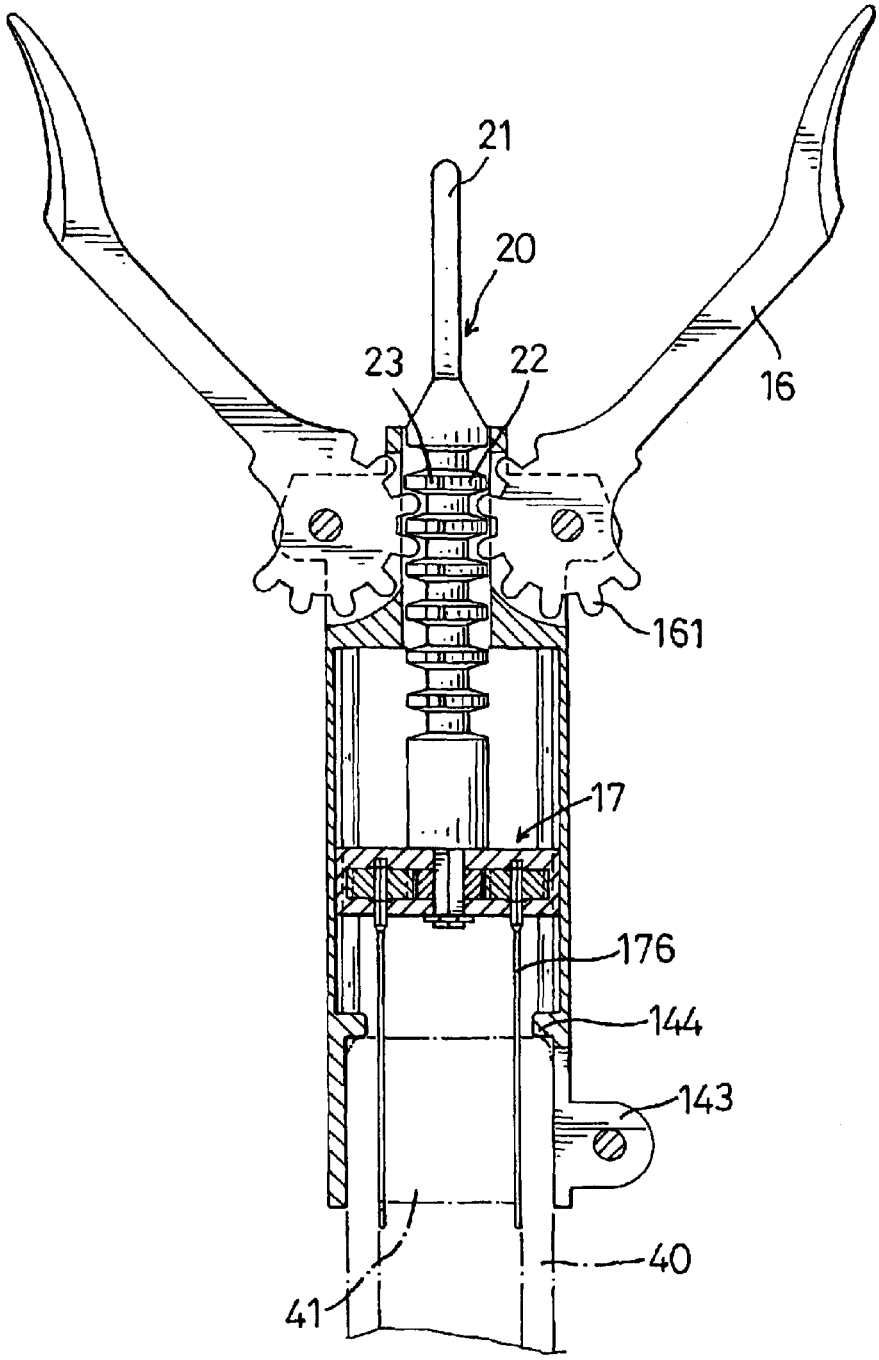
FIG. 3 is a partial plan view of the corkscrew in FIG. 1.
Figure 4:
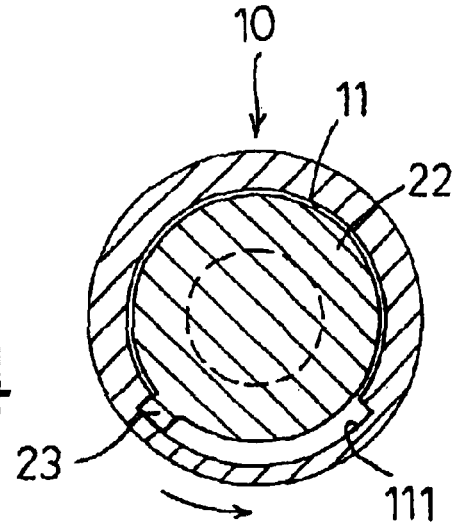
FIG. 4 is a top sectional plan view of the corkscrew in FIG. 1.
Figure 5:
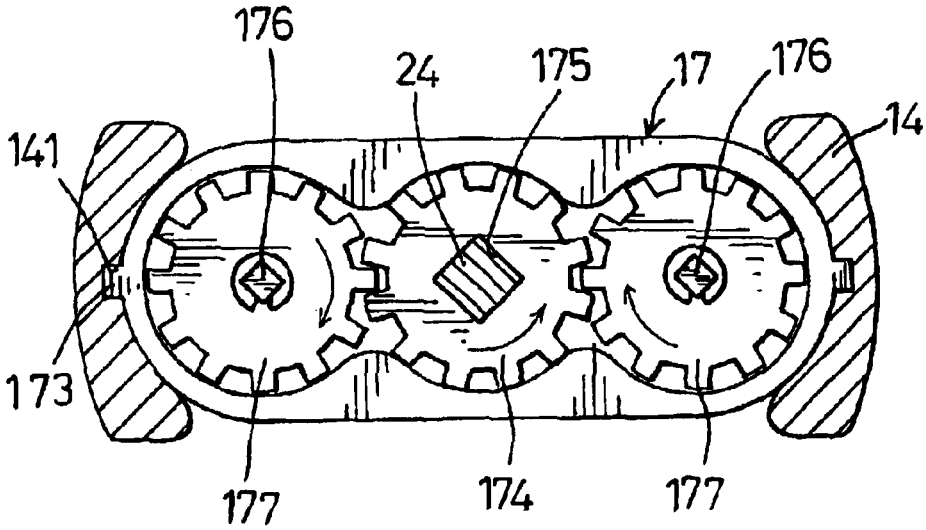
FIG. 5 is a top sectional plan view of the corkscrew in FIG. 1.

With reference to FIGS. 3 to 5, the distal end of the corkscrew is introduced to the neck of the bottle (40) such that the flange of the collar (144) abuts the tip of the bottle neck, and the anchors (176) are thrust into the neck of the bottle (40) and between the inner surface of the bottle (40) and the outside surface of the cork (41). The hooks of the anchors (176) still at 180° before turning around the handle (21). Turning around the handle received inside the recess (111) and than the hooks are engaged with the bottom surface of the cork (41), and the top of the bottle is abutted with the collar (144). The inside surface of the hollow cylinder (14) of the lever corkscrew is securely attached to the outside surface of the neck of the bottle (40) by the quick release handle (143) being moved to reduce the inner diameter of the distal end of the hollow cylinder (14). At the same time, the arms (16) are extended upward and the central spindle (20) is totally inserted into the upper through hole (11) of the body (10). Also, the transport assembly (17) is near the proximal end of the hollow cylinder (14).

When rotating the central spindle (20) with the protrusion key (23) is received inside the recess (111), the post (24) mounted inside the square hole (175) will drive the central gear wheel (174) at the same direction, and also drive the lateral gear wheel (177) rotating in an opposite direction. Because the anchors (176) are connected to the lateral gear wheels (177), the hooks will be rotated 90° relative to their first positions such that they point inwards to each other and engage with a bottom surface of the cork.

Figure 6:
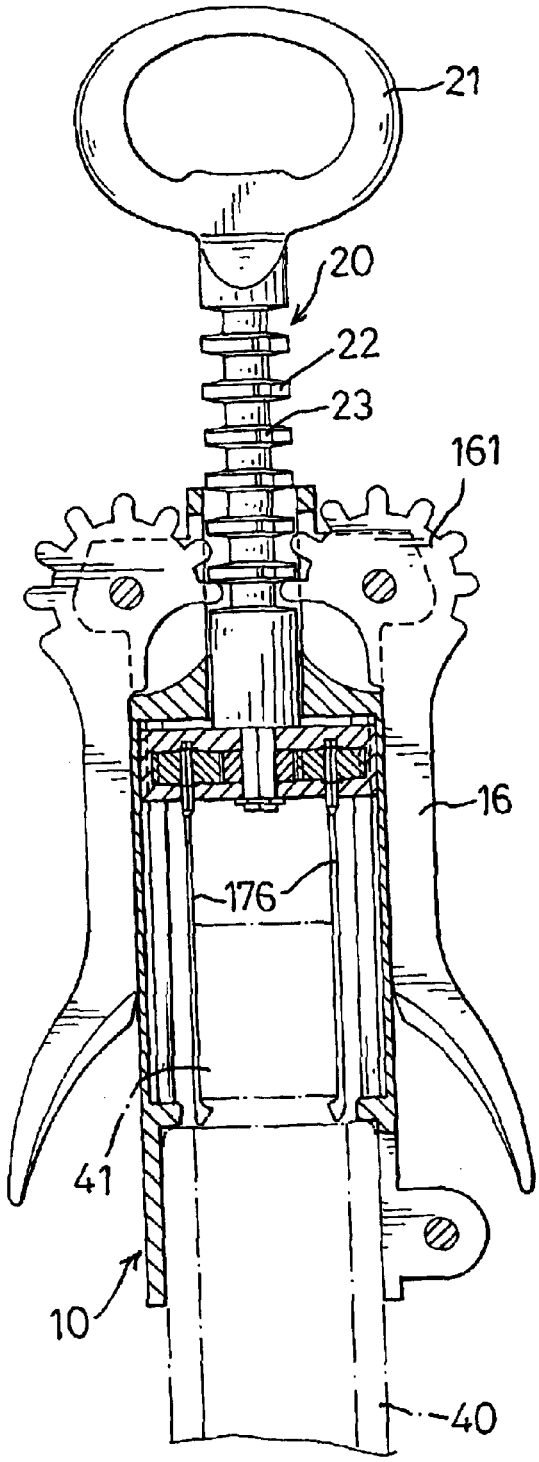
FIG. 6 is an operational partial plan view of the corkscrew in FIG. 1.

With reference to FIG. 6, when pressing the arms (16) are extended toward the distal end of the hollow cylinder (14), the tooth-like protrusions (161) engaged with the lead screw (22) will drive the central spindle (20) to move up and the anchors (16) will directly pull up the cork (41) from inside the bottle (40).

The lever corkscrew in accordance with the present invention has the following advantages:

1. By using the anchors mounted inside the transport assembly, the cork received in the neck of the bottle will be easily pulled out without breakage.

2. When pulling out the entire cork from the bottle, the contents of the bottle will not be contaminated. Even though numerous characteristics and advantages of the present invention have been set forth in the foregoing description, together with details of the structure and function of the invention, that the disclosure is illustrative only, and changes may be made in detail, especially in matters of shape, size, and arrangement of parts within the principles of the invention to the full extent indicated by the broad general meaning of the terms in which the appended claims are expressed is to be understood.

What is claimed is:

1. A lever corkscrew having a body having a distal end;

an inner surface;

an outside surface;

an upper through hole defined through the body; and two shoulders with a bottom side formed on the outside surface of the body;

a hollow cylinder integrally formed with the body and having a proximal end formed with the distal end of the body and the bottom side of the shoulders;

two arms respectively pivoted with one of the shoulders and each arm having a proximal end;

a periphery; and multiple tooth-like protrusions formed on the periphery of the proximal end of the arm;

a transport assembly slidably received inside the hollow cylinder and having a top cover;

a base cover;

an inner cavity formed inside the combined top cover and the base cover;

a central gear wheel with a hole received inside the inner cavity of the transport assembly;

two lateral gear wheels received inside the inner cavity of the transport assembly and engaging with the central gear wheel; and two anchors respectively connected to the lateral gear wheels and each anchor having a distal end with a hook; and a proximal end connected to the lateral gear wheels;

a central spindle slidably inserted into the body, mounted through the transport assembly and having a lead screw extending through the upper through hole in the body, engaging with the multiple tooth-like protrusions of the arms and having a proximal end and a distal end connected to the central gear wheel of the transport assembly; and a handle formed on the proximal end of the lead screw.

2. The lever corkscrew as claimed in claim 1, wherein the hollow cylinder further comprises an inner surface;

an outside surface; and two tracks defined inside the inner surface of the hollow cylinder; and the transport assembly further comprises multiple transverse protrusions respectively formed on two ends of the combined top cover and the base cover and respectively received inside the tracks of the hollow cylinder.

3. The lever corkscrew as claimed in claim 1, wherein the books of the anchors extend along opposite directions before the anchors are adapted to be thrust into a bottle.

4. The lever corkscrew as claimed in claim 1, wherein a recess is defined inside the inner surface of the body and communicated with the upper through hole, and the central spindle further comprises a longitudinal protrusion formed on the lead screw, wherein the longitudinal protrusion is received inside the recess.

5. The lever corkscrew as claimed in claim 2, wherein a distal end of the hollow cylinder further comprises a longitudinal slot, two tabs formed on the outside surface of the hollow cylinder and near the slot, a quick release handle mounted through the tabs, whereby the quick release handle is used to reduced an inner diameter of the distal end of the lever corkscrew.

6. The lever corkscrew claimed in claim 2, wherein the tracks are opposite with each other.

7. The lever corkscrew claimed in claim 2, wherein the hollow cylinder further comprises a collar with an opening at a distal end and an O-shaped flange at the top.

* * * * *